US007799964B2

(12) United States Patent
Minhas et al.

(10) Patent No.: US 7,799,964 B2
(45) Date of Patent: Sep. 21, 2010

(54) MEMBRANE PROCESS FOR LPG RECOVERY

(75) Inventors: Bhupender S. Minhas, Bridgewater, NJ (US); David W. Staubs, Manassas, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 751 days.

(21) Appl. No.: 11/731,871

(22) Filed: Mar. 30, 2007

(65) Prior Publication Data

US 2007/0232847 A1 Oct. 4, 2007

Related U.S. Application Data

(60) Provisional application No. 60/789,489, filed on Apr. 4, 2006.

(51) Int. Cl.
*C07C 7/144* (2006.01)

(52) U.S. Cl. ..... 585/809; 585/818; 208/100; 208/102; 208/103

(58) Field of Classification Search ..... 208/100, 208/102, 103; 585/802, 818, 820
See application file for complete search history.

(56) References Cited

U.S. PATENT DOCUMENTS

| | | | | |
|---|---|---|---|---|
| 4,857,078 | A | 8/1989 | Watler | |
| 4,906,256 | A | 3/1990 | Baker et al. | |
| 5,071,451 | A | 12/1991 | Wijmans | |
| 5,256,295 | A | 10/1993 | Baker et al. | |
| 5,256,296 | A | 10/1993 | Baker et al. | |
| 5,447,559 | A | 9/1995 | Rao et al. | |
| 6,179,996 | B1 | 1/2001 | Baker et al. | |
| 6,183,628 | B1 | 2/2001 | Baker et al. | |
| 6,350,371 | B1 | 2/2002 | Lokhandwala et al. | |
| 6,428,606 | B1 | 8/2002 | Gottschlich et al. | |
| 6,458,900 | B1 * | 10/2002 | Aittamaa et al. | 526/71 |
| 6,592,749 | B1 | 7/2003 | Lokhandwala et al. | |

FOREIGN PATENT DOCUMENTS

| | | |
|---|---|---|
| WO | WO 92/11918 | 7/1992 |

* cited by examiner

*Primary Examiner*—Tam M Nguyen

(57) ABSTRACT

Liquefied Petroleum Gas (LPG) can be recovered from various streams using a multiple membrane recovery process producing hydrogen stream at high yield and high purity and a $C_3^+$ LPG stream at high yield with low energy expenditure.

6 Claims, 2 Drawing Sheets

Conventional Membrane Process for LPG Recovery

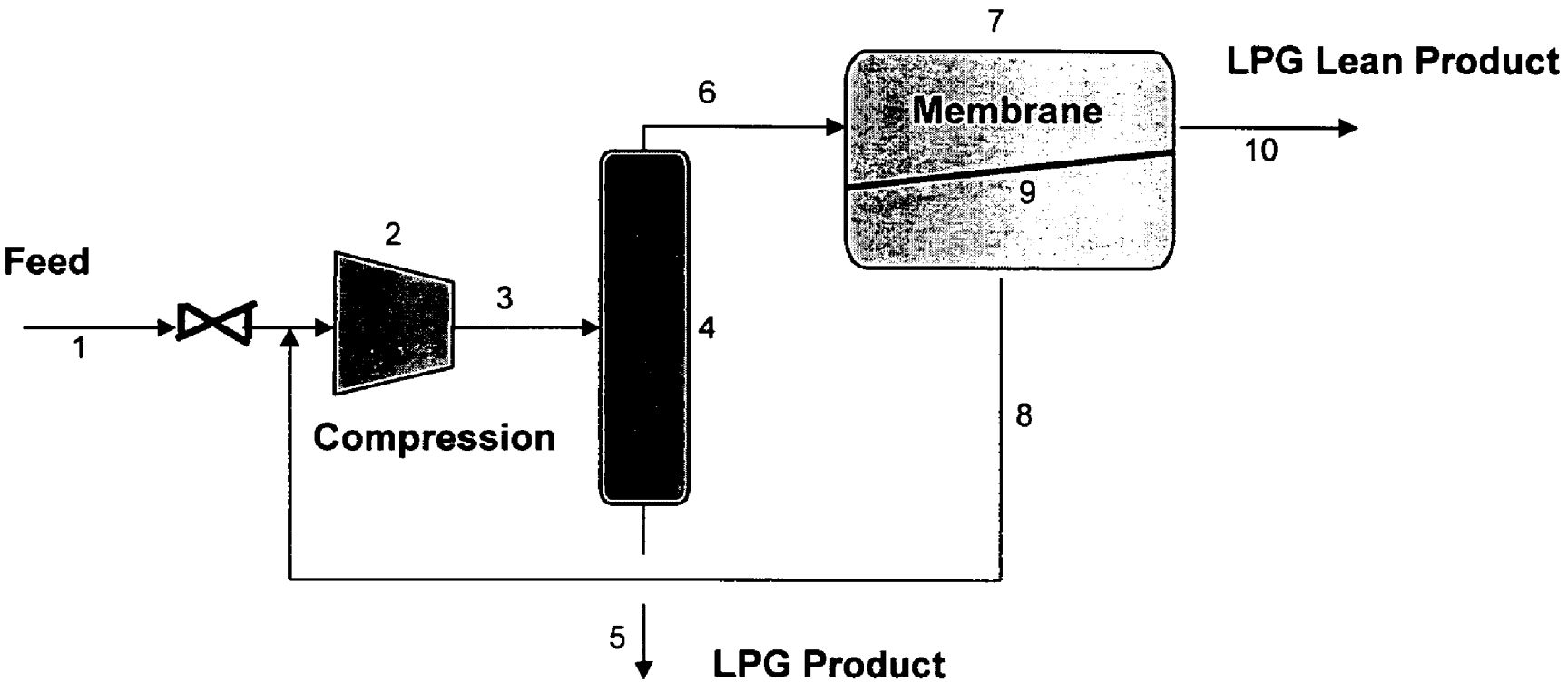
Figure 1: Conventional Membrane Process for LPG Recovery

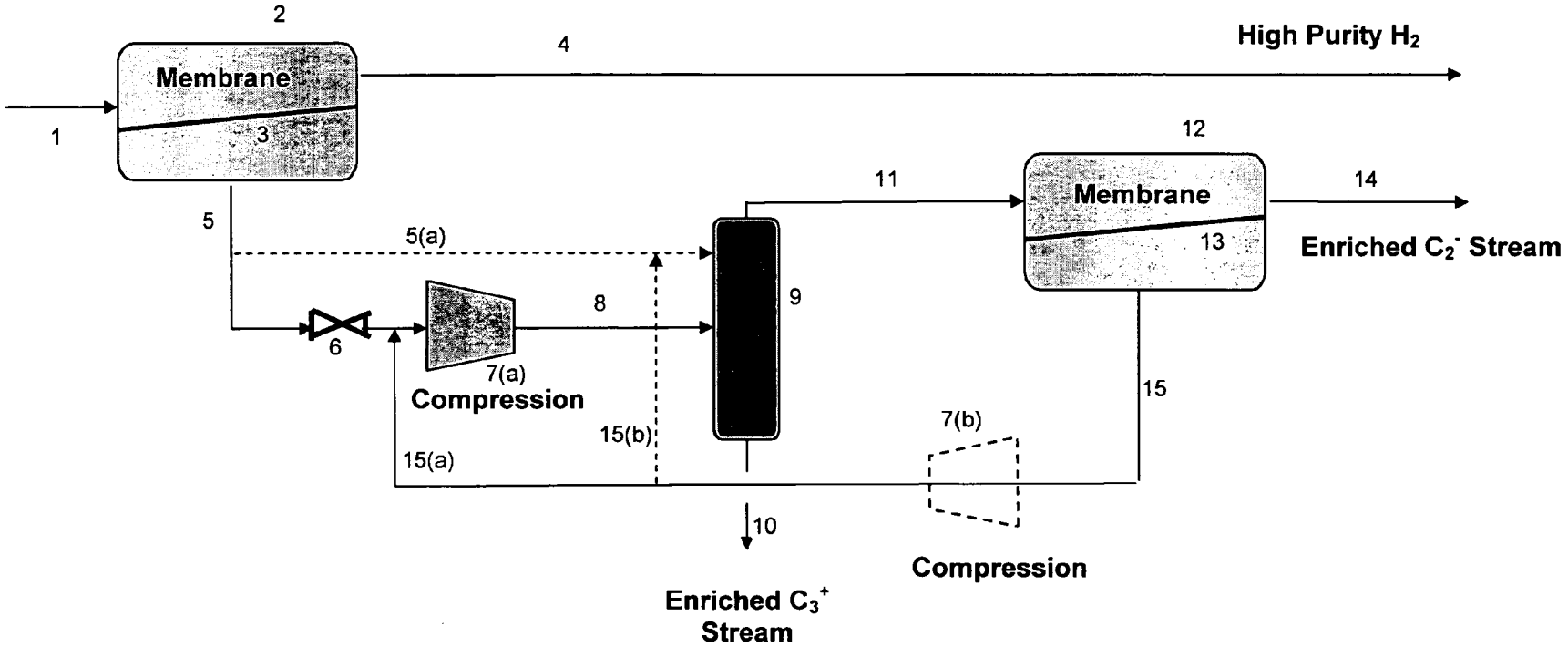
Figure 2: New Membrane Process for LPG Recovery

MEMBRANE PROCESS FOR LPG RECOVERY

CROSS-REFERENCE TO RELATED APPLICATIONS

This application is claims the benefit of U.S. Provisional Patent Application Ser. No. 60/789,489, filed on Apr. 4, 2006.

FIELD OF THE INVENTION

The present invention relates to the recovery of liquefied petroleum gas from various source streams containing $C_3^+$ hydrocarbons.

DESCRIPTION OF THE RELATED ART

Liquefied petroleum gas (LPG) is defined as the $C_3^+$ fraction recovered from various hydrocarbon source streams containing $C_3^+$ such as refinery gases, especially fuel gas streams. The $C_3^+$ fraction constitutes but a small portion of such streams. The low molecular weight stream from such sources contains hydrogen, methane, ethane/ethylene, light gases containing heteroatoms (S, O, N, e.g., mercaptans) as well as the $C_3^+$ fraction valued as LPG. Currently, because of the difficulty involved in further separating the low molecular weight stream from such feed stream into the $C_3^+$ LPG fraction and into the $C_2^-$ light ends fraction, the gaseous, low molecular weight stream separated in gross from the various refinery gas streams is usually utilized as fuel as an on-site fuel source in the refinery or light ends plant without further separation.

Recently, membrane separation has been found to be a cost effective method for processing crude LPG to recover the $C_3^+$ LPG fraction from the light ends fraction, producing a LPG of commercial value but still producing only a single stream of any true value (i.e., the LPG stream). The co-produced streams from these processes contain mixtures of components wherein the lack of purity and high cost of secondary purification only allows them to be economically be utilized for their fuel value in a refinery or light ends plant.

Typically, referring to FIG. 1, in practicing a membrane separation process the crude LPG stream in the form of vapor (stream 1) from whatever source is sent to a compressor (2) for compression to stream (3). This stream is sent to a knock-out drum (4) to remove any condensed hydrocarbons (mostly $C_3^+$) from the bottom as a liquid (5), while vapor is recovered as the vapor overhead (6). This vapor overhead containing hydrogen, $C_1$, $C_2$ and some $C_3^+$ materials is sent to a membrane separation unit (7) wherein the $C_3^+$ LPG material selectively permeates (8) through a rubbery polymeric membrane (9) while the bulk of the $H_2$, $C_1$, $C_2$ and some retained $C_3^+$ material exits the membrane unit as an LPG lean product (10). The LPG rich product in line (8) is recycled to the feed line (1) for recompression in compressor (2) with fresh feed before being fed to knock-out drum (4) wherein via line 5 the LPG product is recovered.

In such a system a good deal of energy is spent compressing the entire crude LPG stream plus recycled $C_3^+$ stream from the membrane unit resulting in the production of the final LPG product stream from the knockout drum. The retentate LPG lean product stream from the membrane unit is of dubious purity and utility and is usually burned as fuel in the refinery or light ends plant. Additionally, due to the high conventional costs of recovering purified hydrogen from the LPG lean product stream for use in hydrogen-valued refinery processes such hydrotreating, hydrodesulfurization, or hydrocracking, this valuable hydrogen is used in the resulting product stream as a fuel gas where it has very low value as a heating fuel.

Steams with of less than about 70 to 80 mol % hydrogen generally cannot be economically used in hydrogen-valued refinery processes such hydrotreating, hydrodesulfurization, or hydrocracking. Hydrogen purities of at least 80 mol % and preferably at least 90 mol % are generally utilized in these hydrogen consuming processes as hydrogen purities of lower values tend to significantly back capacity out of these hydrogen consuming processes, as well as significantly reduce the selected conversion of the processes due to undesirably low hydrogen partial pressures in the processes. Additionally, the higher molecular weight contaminants that make up the remainder of the stream tend to crack in these processes into low value products.

Streams of hydrogen purities of at least 80 mol % are preferred for use and streams of hydrogen purities of at about 70 to 90 mol % have suitable purity to allow them to be blended with high purity (95+mol % hydrogen) for use in refinery hydroprocessing applications. However, streams of hydrogen purities of less than 70 mol % generally are too low to be utilized for these processes and are generally sent to the fuel gas systems.

It is desirable, therefore, to have a process wherein the crude LPG from whatever source is efficiently and cost effectively separated into a stream of high purity $C_3^+$ stream and still obtain another stream containing high purity hydrogen which is of sufficient purity to be utilized in hydrogen-valued refinery processes.

SUMMARY OF THE INVENTION

The claimed invention is a multiple membrane process for recovering a $C_3^+$ rich LPG stream and a high purity hydrogen stream from a hydrocarbon-containing feedstream comprised of hydrogen and $C_1$, $C_2$ and $C_3$+ hydrocarbons.

In a preferred embodiment, the present invention is a process for the recovery of a $C_3^+$ rich LPG stream and a high purity hydrogen stream from a hydrocarbon-containing feedstream comprised of hydrogen and $C_1$, $C_2$ and $C_3$+ hydrocarbons, comprising:

(a) feeding the hydrocarbon feedstream into a first membrane separation unit wherein the hydrocarbon-containing feedstream is contacted with a first side of at least one first rubbery polymer membrane, (b) retrieving a first retentate product stream which has a higher hydrogen mol % than the hydrocarbon-containing feedstream from the first side of the first rubbery polymer membrane and retrieving a first permeate product stream which has a higher $C_3^+$ mol % than the hydrocarbon-containing feedstream from a second side of the first rubbery polymer membrane, (c) feeding the first permeate product stream to a compressor wherein the first permeate product stream is raised in pressure, (d) feeding the higher pressure first permeate product stream to a knockout drum, (e) retrieving a liquid $C_3^+$ rich LPG product stream from the knockout drum, wherein the $C_3^+$ rich LPG product stream has a higher $C_3^+$ mol % than the first permeate product stream, (f) retrieving a vapor $C_2^-$ rich stream from the knockout drum, wherein the $C_2^-$ rich stream has a higher $C_2^-$ mol % than the first permeate product stream, (g) feeding $C_2^-$ rich stream into a second membrane separation unit wherein the $C_2^-$ rich is contacted with a first side of at least one second rubbery polymer membrane, (h) retrieving a second retentate product stream which has a higher $C_2^-$ mol % than the $C_2^-$ rich stream from the first side of the second rubbery polymer membrane and retrieving a second permeate product stream which has a higher $C_3^+$ mol % than the $C_2^-$ rich stream from a second side of the second rubbery polymer membrane, and (i) mixing at least a portion of the second permeate product stream with the first permeate product stream at a point upstream of the compressor.

In another preferred embodiment, the present invention is a process for the recovery of a $C_3^+$ rich LPG stream and a high purity hydrogen stream from a hydrocarbon-containing feedstream comprised of hydrogen and $C_1$, $C_2$ and $C_3$+ hydrocarbons, comprising:

(a) feeding the hydrocarbon-containing feedstream into a first membrane separation unit wherein the hydrocarbon-containing feedstream is contacted with a first side of at least one first rubbery polymer membrane, (b) retrieving a first retentate product stream which has a higher hydrogen mol % than the hydrocarbon-containing feedstream from the first side of the first rubbery polymer membrane and retrieving a first permeate product stream which has a higher $C_3^+$ mol % than the hydrocarbon-containing feed stream from a second side of the first rubbery polymer membrane, (c) feeding the first permeate product stream to a knockout drum, (d) retrieving a liquid $C_3^+$ rich LPG product stream from the knockout drum, wherein the $C_3^+$ rich LPG product stream has a higher $C_3^+$ mol % than the first permeate product stream, (e) retrieving a vapor $C_2^-$ rich stream from the knockout drum, wherein the $C_2^-$ rich stream has a higher $C_2^-$ mol % than the first permeate product stream, (f) feeding $C_2^-$ rich stream into a second membrane separation unit wherein the $C_2^-$ rich is contacted with a first side of at least one second rubbery polymer membrane, (g) retrieving a second retentate product stream which has a higher $C_2^-$ mol % than the $C_2^-$ rich stream from the first side of the second rubbery polymer membrane and retrieving a second permeate product stream which has a higher $C_3^+$ mol % than the $C_2^-$ rich stream from a second side of the second rubbery polymer membrane, (h) feeding at least a portion of the second permeate product stream to a compressor wherein the second permeate product stream is raised in pressure, (i) mixing the higher pressure second permeate product stream with the first permeate product stream at a point upstream of the knockout drum.

DESCRIPTION OF THE FIGURES

FIG. 1 is a schematic of a typical LPG recovery process utilizing a single membrane separation unit producing a single valuable stream.

FIG. 2 is a schematic of preferred embodiments of an improved LPG recovery process of the present invention using an integration of two membrane separation units producing three streams: a high purity LPG stream, a high purity hydrogen stream, and a $H_2$ lean/enriched $C_2^-$ stream.

DETAILED DESCRIPTION OF THE INVENTION

The present invention is a process for recovering high purity LPG from a crude LPG stream, from any source such as refinery gases, especially fuel gas streams which contain hydrogen, methane, ethane/ethylene, light gases containing heteroatoms (sulfur, oxygen, nitrogen, e.g., mercaptans) as well as the $C_3^+$ fraction valued as LPG and simultaneously recovering a high purity hydrogen rich stream by the use of two membranes separation units. In the present invention, the first membrane separation unit is located before a first optional compressor and a knockout drum and the second membrane separation unit is located after the knockout drum with recycle of the $C_3^+$ rich stream from the second membrane unit for combination with the crude LPG feed for repassage through the knockout drum. The current invention results in the production and recovery of high purity LPG from the knockout drum and the production and recovery of high purity hydrogen retentate from the first membrane. This high purity hydrogen obtained from the first membrane unit is of sufficient purity to be utilized as a hydrogen stream component for a refinery hydroprocessing process. The retentate of the second membrane unit contains mainly other lighter hydrocarbons such as $C_1$ and $C_2$, i.e., a $C_2^-$ enriched/LPG lean stream as is generally utilized as fuel gas.

The bulk of the crude LPG stream is sent first to a membrane separation unit under the pressure at which it is received from its source such as 50 to 1000 psi (no pre-compression step being practiced) and the crude stream is divided into a $H_2$ lean and $C_3^+$ LPG enriched permeate stream and a $H_2$ rich retentate stream. The permeate stream, at reduced pressure, and of reduced volume due to the removal of the $H_2$ and some $C_2^-$ retentate stream can be fed as such to the knockout drum or can be recompressed in a first optional compressor before being sent to the knockout drum. Because of the reduced volume of this stream, if a compressor is required in the present process, a smaller compressor can be utilized than if the hydrogen was not removed prior to the compression step upstream of the knock-out drum. This results is both lower investment costs and lower energy consumption.

In one embodiment of the process of the present invention as presented in FIG. 2, raw LPG feed from whatever source is fed at whatever pressure it is received from its source, typically 50 to 1000 psi, via line (1) into a first membrane unit (2), wherein it is contacted with a rubbery polymer membrane (3). The raw LPG feed is separated by the membrane into a retentate product stream (4) enriched in hydrogen, and into a lower/reduced pressure permeate stream (5) enriched in $C_3^+$ LPG hydrocarbons and a reduced concentration of hydrogen as compared to the feedstream. The lower pressure permeate stream enriched in $C_3^+$ LPG concentration but still containing some hydrogen albeit at a reduced concentration is passed via line 5 though optional valve (6) to optional compressor (7*a*) wherein its pressure can be increased at least back up to the pressure of the of the crude LPG, e.g., 50 to 1000 psi and then through line (8) to knockout drum (9) wherein high purity $C_3^+$ LPG is liquefied and recovered as product via line (10) and a vaporous phase is recovered as overheads via line (11) and sent to a second membrane unit (12) where it is contacted with a rubbery polymer membrane (13). In the second membrane unit (12), the vaporous overheads stream from knockout drum (9) is separated into a retentate stream (14) rich in $C_1$ and $C_2$ and of reduced $C_3^+$ LPG content and into a reduced pressure permeate stream (15) rich in $C_3^+$ LPG. The permeate stream is fed via line (15), without the use of the optional compressor shown as 7(*b*), to a point upstream of compressor 7(*a*) where it is combined with the permeate stream from the first membrane separation unit.

In another embodiment, if the pressure of the permeate stream in line (5) is sufficient, compressor 7(*a*) may be omitted. In this alternate embodiment, the permeate is fed to knockout drum (9) via line (5*a*). In the second membrane unit (12), the vaporous overheads stream from knockout drum (9) is separated into a retentate stream (14) rich in $C_1$ and $C_2$ and of reduced $C_3^+$ LPG content and into a reduced pressure permeate stream (15) rich in $C_3^+$ LPG. The permeate stream is fed via line (15) to compressor (7*b*) which is employed in this embodiment. The compressed permeate stream is recycled via line (15*b*) into line (5*a*) for combining therein with the permeate from line (5) for introduction/reintroduction into the knockout drum (9).

While compressors 7(*a*) and 7(*b*) are identified as optional, one or the other is required to repressurize the stream(s) recovered at reduced pressure as permeate either from the first membrane separation unit (2), stream (5), or from the second membrane separation unit (12), stream (15) so as to facilitate the processing and/or recycling of these streams in the processing circuit. Passage through each membrane unit results in a permeate recovered at a pressure lower than that of the feed to the membrane unit. Compressor (7*a*) can be omitted if the pressure of the reduced pressure permeate in line (5) is still high enough to permit effective separation in the knockout drum (9) membrane unit (12) circuit. If not, then recompression in a compressor (7*a*) is necessary. If the pressure in line (5) is sufficient without recompression in compressor (7*a*) for passage to knockout drum (9) and membrane unit (12) the permeate recovered from membrane unit (12) in line (15) will be at yet a still lower pressure (lower than that in line 5/5*a*) so recycle of this permeate for recycle to the knockout drum (9) would require repressurization by compressor (7*b*).

In the membrane separations units, gas molecules sorb (i.e., either absorb or adsorb) onto the polymer film used as the membrane on the feed side of the membrane, usually under pressure (usually an applied pressure). This sorption creates a concentration gradient of molecules from the feedside to the permeate side of the membrane film. Gas molecules diffuse through the membrane film from the feed side to the permeate side under the influence of the concentration difference with the sorbed materials desorbing from the permeate face of the membrane film into the lower pressure permeate side of the membrane separation unit. This pressure differential may be the result of a higher or applied pressure on the feed side of the membrane than the pressure on the permeate side of the membrane and/or the permeate side can be under a partial or full vacuum to create the necessary pressure differential.

In gas separation most of the membranes used are glassy polymers such as cellulose acetate, polysulfone, polyamide, polyimide, etc., and combination of such polymers. In glassy polymers the polymer molecule are rigidly packed in the membrane film, therefore diffusion in restricted and the diffusion rate controls the separation. Larger molecules have slower diffusion rates. Thus, glassy polymer membranes can be used to separate small molecules such as hydrogen (kinetic diameter 2.89 Å) from larger molecules such as methane (kinetic diameter 3.8 Å) and propane (kinetic diameter 4.3 Å) but because of the reduced diffusion rate the rate of separation is low.

In the recovery of LPG, as practiced in the present invention use is made of rubbery polymer such as polysiloxane, polybutadiene, etc. In this rubbery state, the polymer molecules in the membrane film are packed relatively loosely resulting in high flexibility of the rubbery polymer film and flexibility between the different polymer strands that comprise the membrane. Thus, diffusion rate differences between smaller molecules and larger molecules are insignificant. Herein, the selective separation is primarily driven not by differentiation in molecular size but instead by affinity of the membrane for certain constituents in the feed. The sorption on the feed side in LPG recovery using these rubbery polymer membranes favors large $C_3$ molecules rather than the smaller hydrogen, $C_1$ or $C_2$ molecules.

Because of the higher sorption of the $C_3^+$ molecules, more $C_3^+$ molecules sorb on the feed side resulting in more $C_3^+$ molecules permeating through the membrane to the permeate side resulting in the separation of $C_3^+$ molecules from the hydrogen and $C_1$ and $C_2$ molecules present in feed. In a preferred embodiment, the process of the present invention will produce a $C_3^+$ rich product stream that has a $C_3^+$ purity of at least 70 mol %, more preferably at least 80 mol %. In a preferred embodiment, the process of the present invention produces a $C_3^+$ rich product stream wherein the wt % of the $C_3^+$ component in the $C_3^+$ rich product stream is at least 80 wt % of the $C_3^+$ component in the hydrocarbon-containing feedstream to the process. More preferably the process of the present invention produces a $C_3^+$ rich product stream wherein the wt % of the $C_3^+$ component in the $C_3^+$ rich product stream is at least 90 wt % of the $C_3^+$ component in the hydrocarbon-containing feedstream to the process.

Similarly, a rubbery polymer membrane such as polysiloxane, polybutadiene, etc., can be utilized in the first membrane separation unit to produce a lower molecular weight hydrogen-rich stream as a retentate at high purities (greater than 70 mol %) and produce a $C_2^+$ rich permeate stream which can then be further purified for LPG recovery. In a preferred embodiment, the process of the present invention will produce a hydrogen rich product stream that has a hydrogen purity of at least 70 mol %, more preferably at least 80 mol %. In a preferred embodiment, the process of the present invention produces a hydrogen rich product stream wherein the wt % of the hydrogen component in the hydrogen rich product stream is at least 40 wt % of the hydrogen component in the hydrocarbon-containing feedstream to the process. More preferably the process of the present invention produces a hydrogen rich product stream wherein the wt % of the hydrogen component in the hydrogen rich product stream is at least 50 wt %, and even more preferably at least 60 wt % of the hydrogen component in the hydrocarbon-containing feedstream to the process.

The preferred rubbery polymers useful in the present process are those which have a glass transition temperature below 20° C., i.e., which are rubbery at room temperature or higher (about 20° C. or higher). The same or different rubbery polymer membranes may be used in each membrane separation unit.

EXAMPLE A

In Example A, a feed nominally corresponding to the feed presented in Table 1 was employed. Feed compositional profile:

TABLE 1

| Deisohexanizer Offgas Composition | | |
|---|---|---|
| Flow | 49.11316 | lb mol/hour |
| Pressure | 136 | psia |
| $H_2$ | 49.845 | mole % |
| $C_1$ | 9.961 | mole % |
| $C_2$ | 16.442 | mole % |
| $C_3$ | 8.5309 | mole % |
| $iC_4$ | 2.9003 | mole % |
| $C_4$ | 7.0507 | mole % |
| $iC_5$ | 2.3802 | mole % |
| $C_5$ | 1.9602 | mole % |
| $C_6^+$ | 0.93009 | mole % |
| $C_3^+$, bpd | 75.53414 | |

The feed was subjected to membrane separation under the following conditions:

Feed pressure to membrane unit: 135.7 psia

Retentate pressure: 120.7 psia

Permeate pressure: 56.7 psia

The results obtained are presented in Table 2 below:

TABLE 2

| Components (mole %) | Retentate | Permeate |
|---|---|---|
| $H_2$ | 55.5 | 29.5 |
| Methane | 10.5 | 8.6 |
| Ethane | 14.6 | 21.8 |
| Propane | 7 | 13.3 |
| Iso Butane | 2.3 | 4.8 |
| N Butane | 5.5 | 11.8 |
| Iso Pentane | 1.8 | 4.2 |
| N Pentane | 1.5 | 3.5 |
| $C_6^+$ | 0.7 | 1.8 |
| Total | 99.4 | 99.3 |

This information was used to design a computer simulated series of Comparative Examples and Examples which presumed the pressure conditions presented below.

Pressure Conditions Assumed for Computer Simulation

COMPARATIVE EXAMPLES 1-3 AND EXAMPLES 1-7

Feed at 136 psia to the first membrane unit

Retentate at 133.6 ($H_2$ rich stream)

Permeate 20 psia from first membrane unit

Compressor discharge: 250 psia at 100° F.

Membrane 2 feed at 245 psia and 100° F.

Retentate from membrane 2 unit at 238.7 psia

Permeate 2 at 20 psia

The utility of the present invention is demonstrated by the non-limiting information presented in Table 3.

The membrane used to generate the base data of Example A which was an actual and not a computer simulated example was secured from Membrane Technology & Research (MTR), and is a rubbery polymeric membrane identified as a "PDMS membrane". The computer simulated comparative Examples 1-3 are based on the actual data generated in Example A but present the calculated results secured if a compressor is employed and if the surface area of the first membrane unit were to be increased (or if additional units were employed (Comparative Examples 1, 2 and 3) or in Examples 1-7 if a second membrane unit were to be employed following the knockout drum.

In Table 3 Comparative Examples 1, 2 and 3 are comparative examples run in accordance with the scheme presented in FIG. 1, but omitting the compressor, the feed being processed at 135.7 psia, the pressure at which it was secured without additional compression. In the computer simulated Comparative Examples 1, 2 and 3 the membrane surface area was presumed to be about 202, 358 and 693 square feet, respectively, representative of using different size membrane units or multiple membrane units in parallel.

By comparison, computer simulated examples 1-7 are examples of the present invention in which membrane separation units are employed on each of the feed prior to the knockout drum (i.e., the "first membrane separation unit") and the vapor stream leaving the knock out drum (i.e., the "second membrane separation unit")

In these examples 1-7, referring to FIG. 3, it was presumed that the feed in line 1 was at 135.7 psia, the retentate in line 4 was recovered at 133.6 psia, the permeate in line 5 was at 20 psia, the compressor repressurized the permeate in line 5 up to 250 psia at 100° F. (line 8) all these conditions being the same as in Example 1. In the computer simulation it was presumed that the feed to membrane unit (12) in line 11 was at 245 psia @ 100° F. while the retentate in line 14 was at 238.7 psia and the permeate in line 15 was at 20 psia.

As is readily apparent, whereas the hydrogen purity from the first three (comparative examples) was calculated as being at best 67.8% using 693 sq. ft. of membrane with a $C_3^+$ LPG purity of 83.47%, in the present invention, at equivalent membrane surface area (Example 5), the hydrogen purity is calculated as potentially reaching 80.6% at 58.56% recovery while $C_3^+$ LPG purity is calculated as being as high as 82.8% at 92.7% recovery. It is calculated that increasing the surface area of the first membrane unit (unit 2 of FIG. 2) would result in a further increase in hydrogen purity but at reduced recovery and an increase in $C_3^+$ LPG purity but also at reduced recovery.

Thus by the practice of the dual membrane separation unit process of the present invention, it is calculated that it should be possible to recover not only a $C_3^+$ LPG stream of substantially the same purity and yield as in a single membrane separation unit process, but also to recover a $H_2$ stream of significantly increased hydrogen purity while using smaller compressor(s) as evidenced by the significantly lower horsepower requirements of the multiple membrane unit process of the present invention as compared against the single membrane unit process.

The above description of preferred embodiments is directed to preferred means for carrying out the present invention. Those skilled in the art will recognize that other means that are equally effective could be devised for carrying out the spirit of this invention.

TABLE 3

| | First | Second | $H_2$ Rich Stream | | $C_3^+$ LPG Stream | | $H_2$ Lean Stream | | |
|---|---|---|---|---|---|---|---|---|---|
| Experiment | membrane area $ft^2$ | membrane area $ft^2$ | $H_2$ purity mol % | $H_2$ wt % recovered | mol % purity | $C_3^+$ wt % recovered | $H_2$ purity mol % | $H_2$ wt % recovered | Compressor HP |
| Comparative Example 1 | 202 | 0 | 61 | 99.69 | 88.2 | 74.7 | — | — | 134 |
| Comparative Example 2 | 358 | 0 | 64.3 | 99.81 | 86.4 | 87.9 | — | — | 179 |
| Comparative Example 3 | 693 | 0 | 67.8 | 99.94 | 83.47 | 97 | — | — | 283 |
| Example 1 | 200 | 200 | 64.6 | 85.39 | 77.7 | 74.3 | 56.22 | 14.46 | 94 |

TABLE 3-continued

| Experiment | First membrane area ft$^2$ | Second membrane area ft$^2$ | $H_2$ Rich Stream $H_2$ purity mol % | $H_2$ Rich Stream $H_2$ wt % recovered | $C_3^+$ LPG Stream mol % purity | $C_3^+$ LPG Stream $C_3^+$ wt % recovered | $H_2$ Lean Stream $H_2$ purity mol % | $H_2$ Lean Stream $H_2$ wt % recovered | Compressor HP |
|---|---|---|---|---|---|---|---|---|---|
| Example 2 | 300 | 200 | 70.8 | 76.98 | 79.74 | 87.3 | 53.26 | 22.8 | 102 |
| Example 3 | 350 | 200 | 73.6 | 72.55 | 80.61 | 90.6 | 52.66 | 27.2 | 105 |
| Example 4 | 400 | 200 | 76.1 | 68 | 81.4 | 92.3 | 52.45 | 31.73 | 108 |
| Example 5 | 500 | 200 | 80.6 | 58.56 | 82.8 | 92.7 | 52.77 | 41.13 | 114 |
| Example 6 | 600 | 200 | 84.4 | 48.75 | 84.01 | 90.7 | 53.71 | 50.92 | 118 |
| Example 7 | 800 | 200 | 90.7 | 28.19 | 86.08 | 84.1 | 56.54 | 71.46 | 126 |

What is claimed is:

1. A process for the recovery of a $C_3^+$ rich LPG stream and a high purity hydrogen stream from a hydrocarbon-containing feedstream comprised of hydrogen and $C_1$, $C_2$ and $C_{3+}$ hydrocarbons, comprising:

(a) feeding the hydrocarbon feedstream into a first membrane separation unit wherein the hydrocarbon-containing feedstream is contacted with a first side of at least one first rubbery polymer membrane, (b) retrieving a first retentate product stream which has a higher hydrogen mol% than the hydrocarbon-containing feedstream from the first side of the first rubbery polymer membrane and retrieving a first permeate product stream which has a higher $C_3^+$ mol % than the hydrocarbon-containing feedstream from a second side of the first rubbery polymer membrane, (c) feeding the first permeate product stream to a compressor wherein the first permeate product stream is raised in pressure, (d) feeding the higher pressure first permeate product stream to a knockout drum, (e) retrieving a liquid $C_3^+$ rich LPG product stream from the knockout drum, wherein the $C_3^+$ rich LPG product stream has a higher $C_3^+$ mol % than the first permeate product stream, (f) retrieving a vapor $C_2^-$ rich stream from the knockout drum, wherein the $C_2^-$ rich stream has a higher $C_2^-$ mol % than the first permeate product stream, (g) feeding $C_2^-$ rich stream into a second membrane separation unit wherein the $C_2^-$ rich is contacted with a first side of at least one second rubbery polymer membrane, (h) retrieving a second retentate product stream which has a higher $C_2^-$ mol % than the $C_2^-$ rich stream from the first side of the second rubbery polymer membrane and retrieving a second permeate product stream which has a higher $C_3^+$ mol % than the $C_2^-$ rich stream from a second side of the second rubbery polymer membrane, and (i) mixing at least a portion of the second permeate product stream with the first permeate product stream at a point upstream of the compressor, wherein:

the first retentate product stream has a hydrogen purity of at least 70 mol %;

the wt % of the hydrogen component of the first retentate product stream is at least 40 wt % of the hydrogen component in the hydrocarbon-containing feedstream; and the $C_3^+$ rich LPG product stream has a $C_3^+$ purity of at least 70 mol %; and the wt % of the $C_3^+$ component in the $C_3^+$ rich product stream is at least 80 wt % of the $C_3^+$ component in the hydrocarbon-containing feedstream.

2. The process of claim 1, wherein the rubbery polymer membranes have a glass transition temperature below 20° C.

3. The process of claim 2, wherein at least one of the rubbery polymer membranes is comprised of a material selected from polysiloxane and polybutadiene.

4. A process for the recovery of a $C_3^+$ rich LPG stream and a high purity hydrogen stream from a hydrocarbon-containing feedstream comprised of hydrogen and $C_1$, $C_2$ and $C_3^+$ hydrocarbons, comprising:

(a) feeding the hydrocarbon-containing feedstream into a first membrane separation unit wherein the hydrocarbon-containing feedstream is contacted with a first side of at least one first rubbery polymer membrane, (b) retrieving a first retentate product stream which has a higher hydrogen mol % than the hydrocarbon-containing feedstream from the first side of the first rubbery polymer membrane and retrieving a first permeate product stream which has a higher $C_3^+$ mol % than the hydrocarbon-containing feedstream from a second side of the first rubbery polymer membrane, (c) feeding the first permeate product stream to a knockout drum, (d) retrieving a liquid $C_3^+$ rich LPG product stream from the knockout drum, wherein the $C_3^+$ rich LPG product stream has a higher $C_3^+$ mol % than the first permeate product stream, (e) retrieving a vapor $C_2^-$ rich stream from the knockout drum, wherein the $C_2^{31}$ rich stream has a higher $C_2^-$ mol% than the first permeate product stream, (f) feeding $C_2^-$ rich stream into a second membrane separation unit wherein the $C_2^-$ rich is contacted with a first side of at least one second rubbery polymer membrane, (g) retrieving a second retentate product stream which has a higher $C_2^{31}$ mol % than the $C_2^-$ rich stream from the first side of the second rubbery polymer membrane and retrieving a second permeate product stream which has a higher $C_3^+$mol % than the $C_2^-$ rich stream from a second side of the second rubbery polymer membrane, (h) feeding at least a portion of the second permeate product stream to a compressor wherein the second permeate product stream is raised in pressure, (i) mixing the higher pressure second permeate product stream with the first permeate product stream at a point upstream of the knockout drum, wherein:

the first retentate product stream has a hydrogen purity of at least 70 mol %;

the wt % of the hydrogen component of the first retentate product stream is at least 40 wt % of the hydrogen component in the hydrocarbon-containing feedstream; and the $C_3^+$ rich LPG product stream has a $C_3^+$ purity of at least 70 mol %; and the wt % of the $C_3^+$ component in the $C_3^+$ rich product stream is at least 80 wt % of the $C_3^+$ component in the hydrocarbon-containing feedstream.

5. The process of claim 4, wherein the rubbery polymer membranes have a glass transition temperature below 20° C.

6. The process of claim 5, wherein at least one of the rubbery polymer membranes is comprised of a material selected from polysiloxane and polybutadiene.

* * * * *